US011276952B1

(12) United States Patent
Zou et al.

(10) Patent No.: US 11,276,952 B1
(45) Date of Patent: Mar. 15, 2022

(54) QUICK CONDUCTIVE CONNECTOR DEVICE FOR CHRISTMAS TREES

(71) Applicant: Xinjiang Zou, Meizhou (CN)

(72) Inventors: Xinjiang Zou, Meizhou (CN); Lingong Wang, Nanyang (CN)

( * ) Notice: Subject to any disclaimer, the term of this patent is extended or adjusted under 35 U.S.C. 154(b) by 14 days.

(21) Appl. No.: 17/078,122

(22) Filed: Oct. 23, 2020

(51) Int. Cl.

| | |
|---|---|
| ***H01R 13/46*** | (2006.01) |
| ***H01R 13/502*** | (2006.01) |
| ***H01R 31/06*** | (2006.01) |
| ***H01R 13/02*** | (2006.01) |
| ***H01R 24/20*** | (2011.01) |
| ***H01R 24/86*** | (2011.01) |
| ***H01R 13/62*** | (2006.01) |
| *A47G 33/06* | (2006.01) |

(52) U.S. Cl.
CPC ..... *H01R 13/502* (2013.01); *H01R 13/02* (2013.01); *H01R 13/62* (2013.01); *H01R 24/20* (2013.01); *H01R 24/86* (2013.01); *H01R 31/06* (2013.01); *A47G 33/06* (2013.01)

(58) Field of Classification Search
CPC ..... H01R 13/502; H01R 13/46; H01R 13/02; H01R 13/052; H01R 13/22; H01R 13/62; H01R 13/6205; H01R 13/71; H01R 35/00; H01R 35/02; H01R 35/025; H01R 35/04; H01R 39/00; H01R 24/85; H01R 25/00; H01R 31/06; A47G 33/06; A47G 33/08; A47G 33/0809; A47G 33/0827; A47G 33/04; F21S 10/04; F21S 10/00; F21S 35/00; G02B 6/00
See application file for complete search history.

(56) References Cited

U.S. PATENT DOCUMENTS

| | | | | |
|---|---|---|---|---|
| 8,052,484 | B1 * | 11/2011 | Salisbury | H01R 13/642 439/680 |
| 8,215,977 | B2 * | 7/2012 | Zapf | H01R 13/625 439/352 |
| 8,382,533 | B2 * | 2/2013 | Pavlovic | H01R 13/187 439/840 |
| 8,753,153 | B2 * | 6/2014 | Leon | F16F 1/045 439/840 |
| 9,306,307 | B2 * | 4/2016 | Starke | B21F 11/005 |
| 9,325,113 | B2 * | 4/2016 | Pankau | H01R 13/6272 |
| 9,368,907 | B2 * | 6/2016 | Becker | H01R 13/504 |
| 9,397,428 | B2 * | 7/2016 | Retho | H01R 13/46 |
| 9,843,131 | B2 * | 12/2017 | Kim | H01R 4/023 |
| 10,498,076 | B2 * | 12/2019 | Lee | H01R 13/6273 |

(Continued)

*Primary Examiner* — Harshad C Patel
(74) *Attorney, Agent, or Firm* — W&KIP

(57) ABSTRACT

Disclosed is a quick conductive connector device for Christmas trees, which includes a male connector assembly and a female connector assembly matched with the male connector assembly. The male connector assembly includes a male connector main body. The female connector assembly includes a female connector main body which is sleeved on the male connector main body in a 360-degree rotatable manner. The male connector main body and the female connector main body are plastic insulative parts. The male connector main body is provided with male connector conductive parts, each of which including a circular-ring-shaped annular contact part, and the female connector main body is provided with female connector conductive parts that are in contact with circumferential faces of the annular contact parts of the male connector conductive parts.

8 Claims, 6 Drawing Sheets

(56) References Cited

U.S. PATENT DOCUMENTS

2002/0182917 A1* 12/2002 Kerr, Jr. ..... F21V 23/06
439/314
2018/0131130 A1* 5/2018 Stucchi ..... H01R 13/639

* cited by examiner

QUICK CONDUCTIVE CONNECTOR DEVICE FOR CHRISTMAS TREES

TECHNICAL FIELD

This disclosure relates to the technical field of Christmas tree power connection devices, in particular to a quick conductive connector device for Christmas trees.

BACKGROUND

During Christmas, in order to set off the festival atmosphere, the adoption of Christmas trees for festival embellishment is a necessary item of Christmas. In order to improve the decorative performance of the Christmas trees, string lamps are often hung on the Christmas trees, and the string lamps also become necessary ornaments for Christmas.

When the string lamps are installed on the Christmas trees, a plurality of string lamps need to be sequentially connected and hung at corresponding positions of the Christmas trees; and when the string lamps are connected, the adjacently connected string lamps need to achieve electrical channel connection through corresponding conductive connector devices.

In the related art, there are various types of conductive connector devices for string lamp connection. However, existing conductive connector devices for string lamp connection have an unreasonable design and are not easy to use.

SUMMARY

The disclosure aims to provide a quick conductive connector device for Christmas trees aiming at defects in the related art. The quick conductive connector device for the Christmas trees provides a novel design, simple structure, and ease of use.

In order to achieve the above purpose, the disclosure adopts the following technical scheme:

The quick conductive connector device for the Christmas trees includes a male connector assembly and a female connector assembly matched with the male connector assembly;

the male connector assembly includes a male connector main body, the female connector assembly includes a female connector main body which is sleeved on the male connector main body in a 360-degree rotatable manner, and the male connector main body and the female connector main body are respectively plastic insulative parts;

the male connector main body is provided with male connector conductive parts, each male connector conductive part includes a circular-ring-shaped annular contact part, and the female connector main body is provided with female connector conductive parts making contact with the circumferential faces of the annular contact parts of the male connector conductive parts.

In some embodiments, the male connector main body is provided with three male connector conductive parts, and the annular contact parts of the three male connector conductive parts are coaxially arranged at intervals;

and the female connector main body, corresponding to each male connector conductive part, is provided with the female connector conductive parts respectively, and each female connector conductive part makes contact with the circumferential face of the annular contact part of the corresponding male connector conductive part respectively.

In some embodiments, each male connector conductive part is provided with male connector wiring fixing parts, and the male connector wiring fixing parts of the male connector conductive parts are screwed and fastened on the male connector main body through locking screws;

and each female connector conductive part is provided with a female connector wiring fixing part, and the female connector wiring fixing parts of the female connector conductive parts are screwed and fastened on the female connector main body through locking screws.

In some embodiments, the male connector main body includes a circular-ring-shaped male connector sleeve part, a male connector fixing part is arranged on the inner side of the male connector sleeve part, and the male connector sleeve part and the male connector fixing part are of an integrated structure;

the female connector main body includes a circular-ring-shaped female connector sleeve part, the female connector sleeve part and the male connector sleeve part are rotationally connected in the 360-degree rotatable manner, a female connector fixing part is arranged on the inner side of the female connector sleeve part, and the female connector sleeve part and the female connector fixing part are of an integrated structure;

and the male connector wiring fixing parts are screwed and fastened to the male connector fixing part through locking screws, and the female connector wiring fixing parts are screwed and fastened to the female connector fixing part through locking screws.

In some embodiments, each male connector conductive part is provided with at least two male connector wiring fixing parts which are circumferentially, annularly and uniformly distributed at intervals.

In some embodiments, each female connector conductive part is provided with an elastic contact part which is curved and protrudes towards the side of the annular contact part of the corresponding male connector conductive part, and the elastic contact parts of the female connector conductive parts are elastically in contact with the annular contact parts of the male connector conductive parts.

In some embodiments, the male connector main body is provided with a male connector cover body, and male connector plug wire holes for wires connected with the male connector conductive parts to pass through are formed between the male connector cover body and the male connector main body;

and the female connector main body is provided with a female connector cover body, and female connector plug wire holes for wires connected with the female connector conductive parts to pass through are formed between the female connector cover body and the female connector main body.

In some embodiments, the male connector cover body is screwed and fastened to the male connector main body, and the female connector cover body is screwed and fastened to the female connector main body.

The disclosure provides the beneficial effects that the quick conductive connector device for the Christmas trees of the disclosure comprises a male connector assembly and a female connector assembly matched with the male connector assembly; the male connector assembly includes a male connector main body, the female connector assembly includes a female connector main body which is sleeved on the male connector main body in a 360-degree rotatable manner, and the male connector main body and the female connector main body are respectively plastic insulative parts; the male connector main body is provided with male connector conductive parts, each male connector conductive part includes a circular-ring-shaped annular contact part, and the female connector main body is provided with female connector conductive parts making contact with the circumferential faces of the annular contact parts of the male connector conductive parts. When using the device, the male connector assembly and the female connector assembly can rotate by 360 degrees to adjust the positions according to needs, and electrical conduction can still be guaranteed when the positions are adjusted in a rotating mode; and therefore, by means of the structural design, the device has advantages of a novel design, a simple structure, and ease of use.

BRIEF DESCRIPTION OF THE DRAWINGS

This disclosure is further illustrated below in connection with the accompanying drawings, but the embodiments illustrated in the accompanying drawings are not to be construed as limiting the present disclosure.

DESCRIPTION OF REFERENCE SIGNS IN THE DRAWINGS

Figure 1:
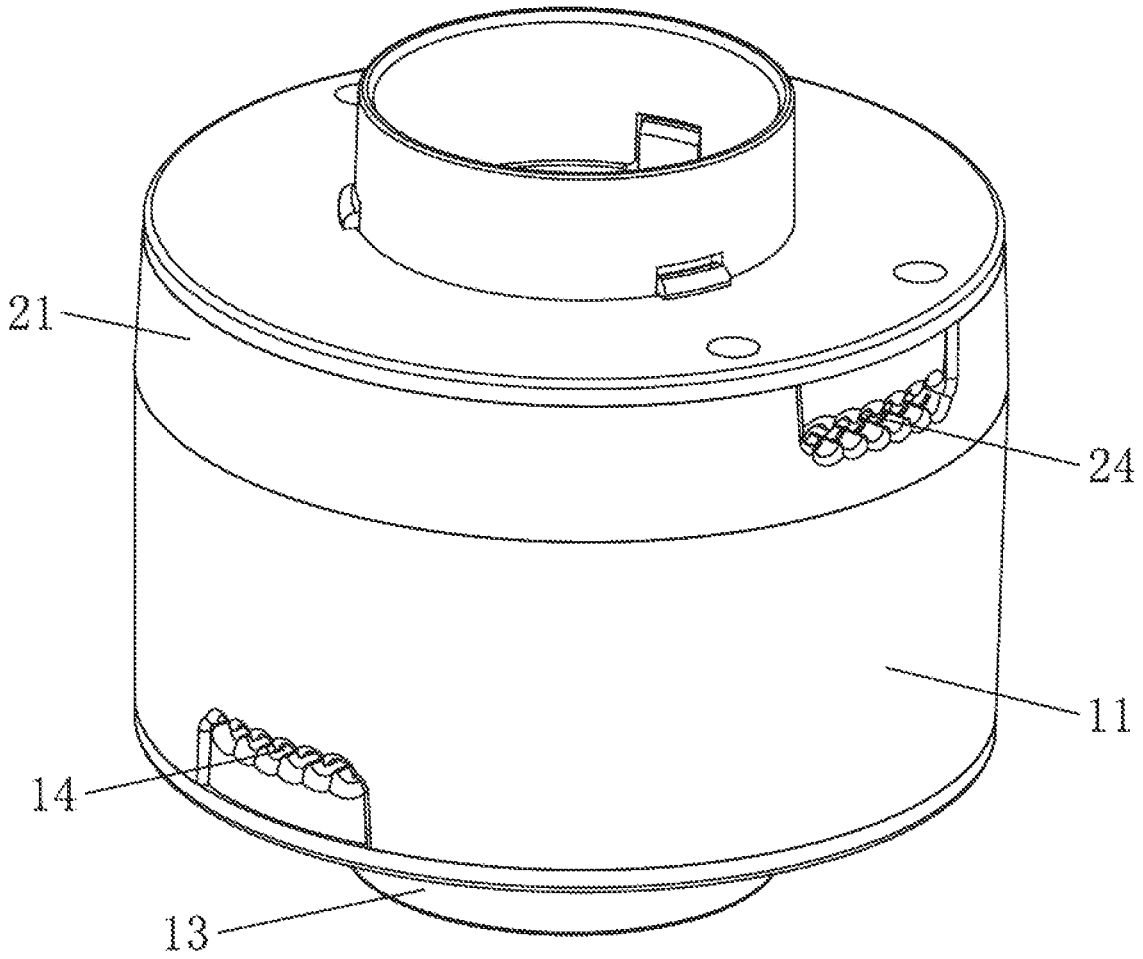
FIG. 1 is a schematic diagram of the present disclosure.

1, male connector assembly; 11, male connector main body

111, male connector sleeve part; 112, male connector fixing part

12, male connector conductive part; 121, annular contact part

122, male connector wiring fixing part; 13, male connector cover body

14, male connector thread hole; 2, female connector assembly

21, female connector main body; 211, female connector sleeve part

212, female connector fixing part; 22, female connector conductive part

221, elastic contact part; 222, female connector wiring fixing part

23, female connector cover body; 24, female connector thread hole

DESCRIPTION OF ILLUSTRATIVE EMBODIMENTS

This disclosure is described below in combination with specific embodiments.

Figure 2:
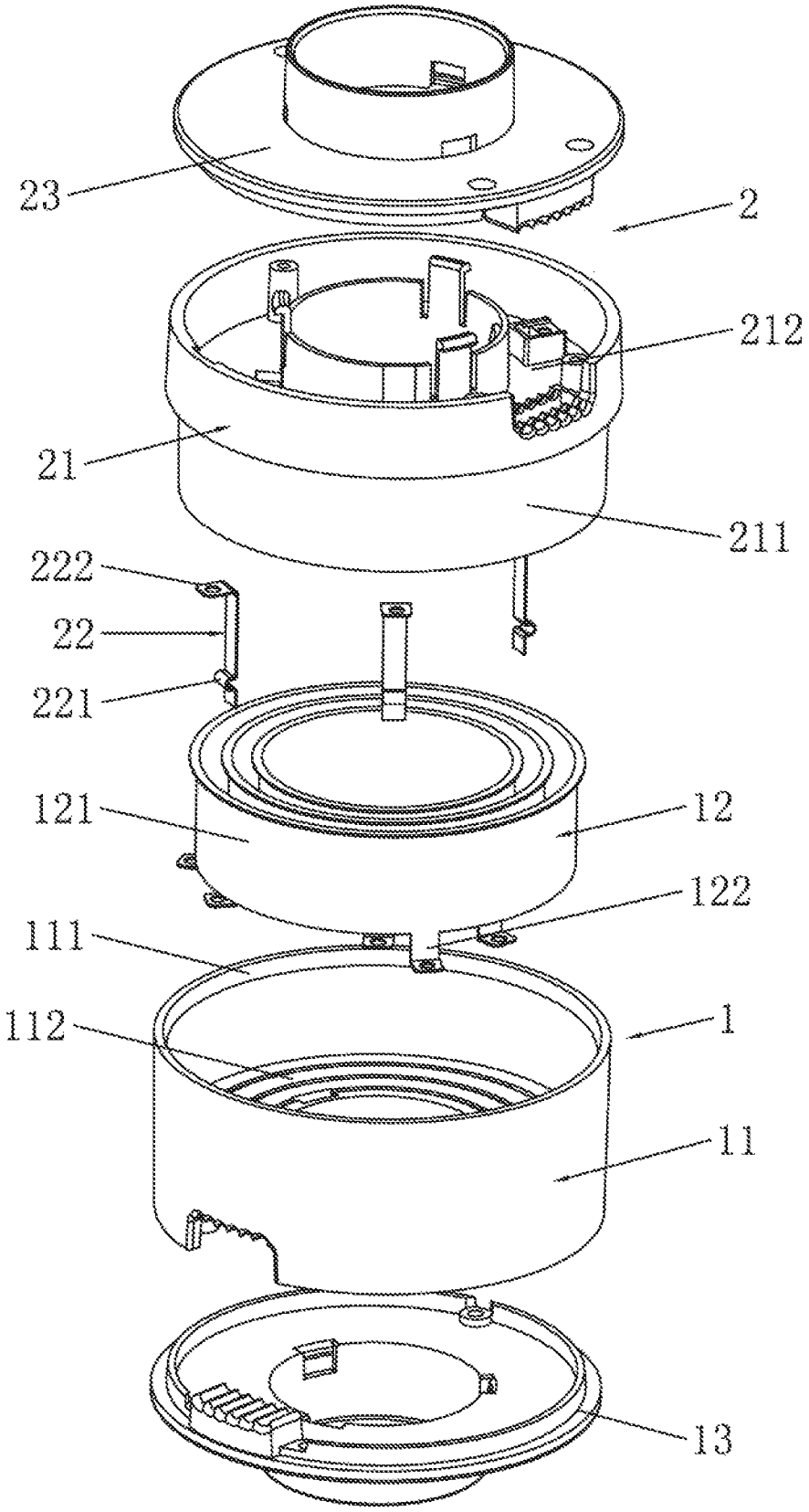
FIG. 2 is an exploded diagram of FIG. 1.
Figure 3:
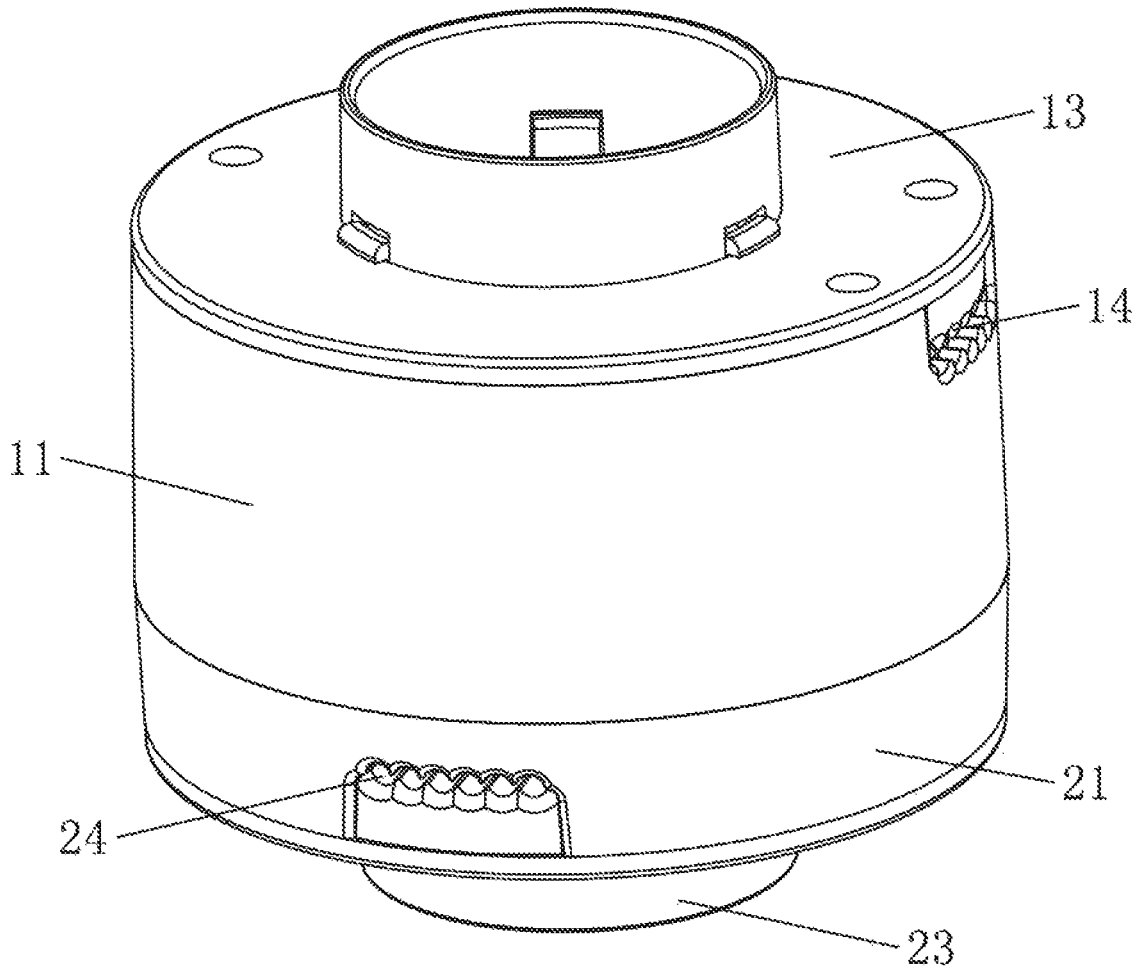
FIG. 3 is a schematic diagram of the disclosure viewed from another perspective.
Figure 4:
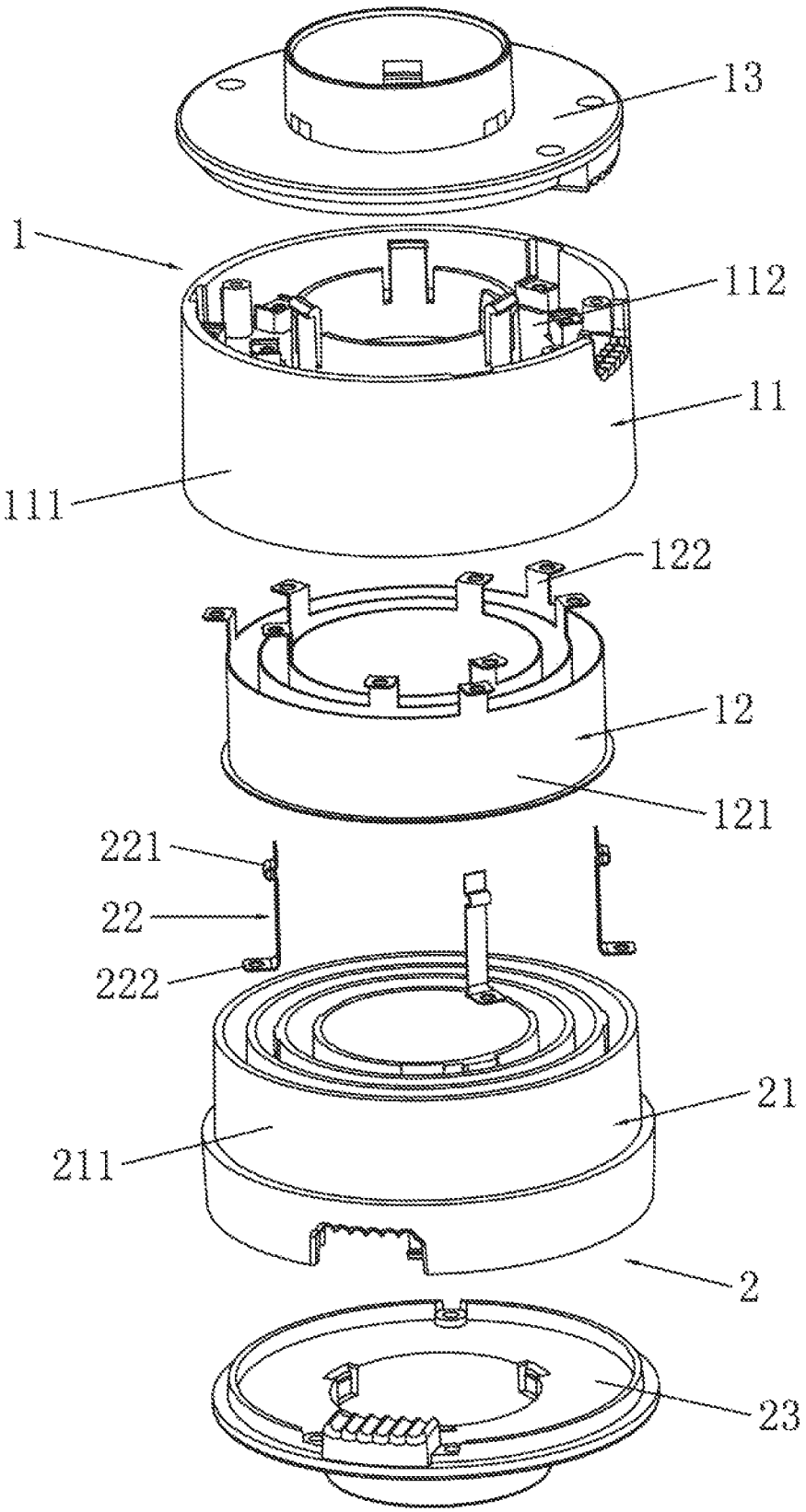
FIG. 4 is an exploded diagram of FIG. 3.
Figure 5:
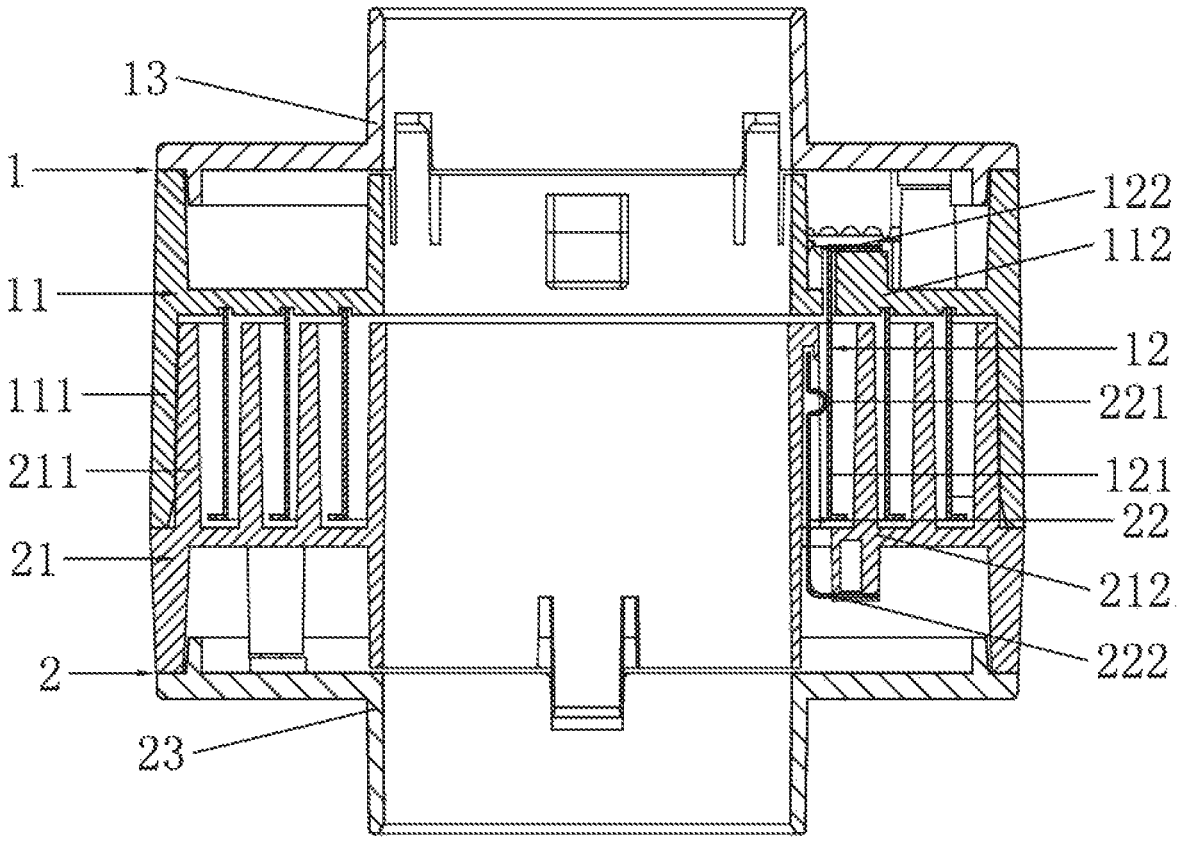
FIG. 5 is a cross-section diagram of the present disclosure.
Figure 6:
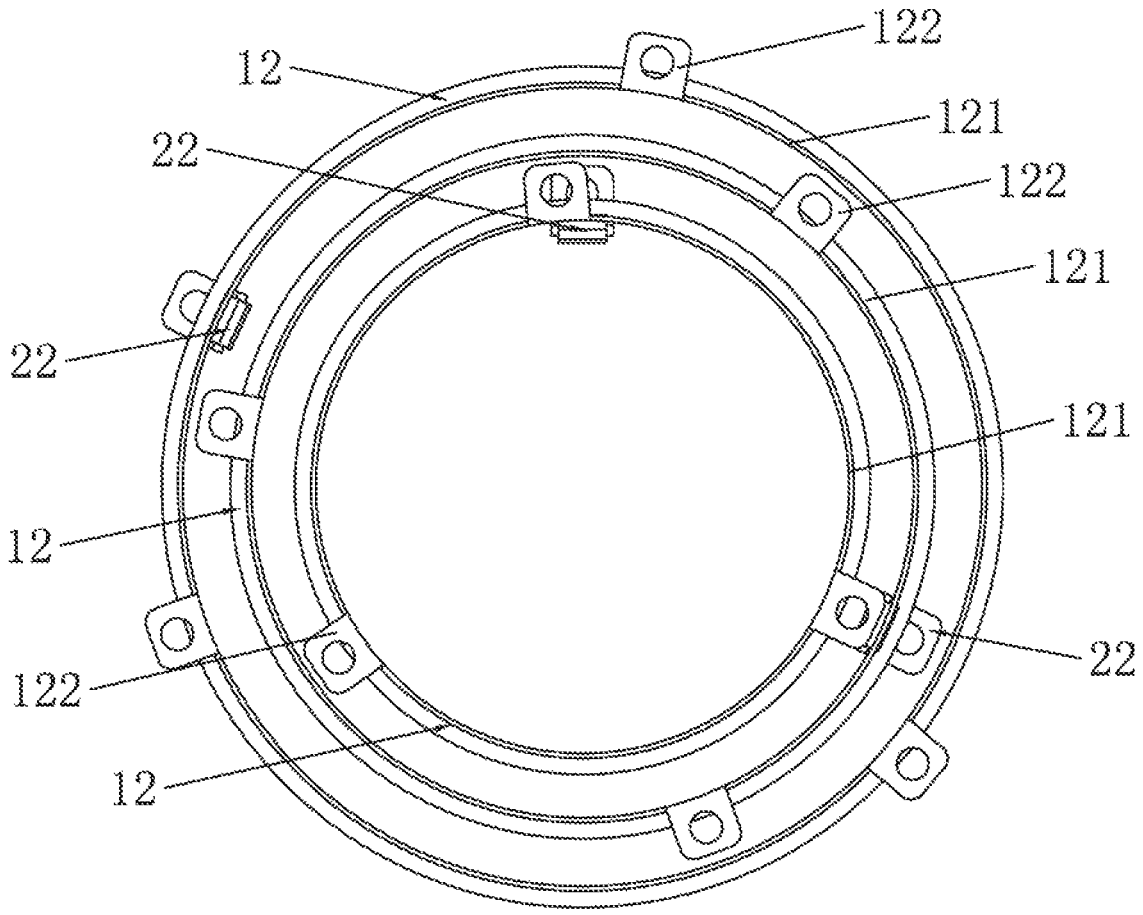
FIG. 6 is a schematic diagram illustrating the connection between the male connector conductive parts and the female connector conductive parts according to the present disclosure.

As illustrated in FIG. 1 to FIG. 6, a quick conductive connector device for Christmas trees comprises a male connector assembly 1 and a female connector assembly 2 matched with the male connector assembly 1;

The male connector assembly 1 may include a male connector main body 11, the female connector assembly 2 comprises a female connector main body 21 which is sleeved on the male connector main body 11 in a 360-degree rotatable manner, and the male connector main body 11 and the female connector main body 21 are respectively plastic insulative parts.

Further, the male connector main body 11 is provided with male connector conductive parts 12, each male connector conductive part 12 comprises a circular-ring-shaped annular contact part 121, and the female connector main body 21 is provided with female connector conductive parts 22 making contact with the circumferential faces of the annular contact parts 121 of the male connector conductive parts 12.

Typically, as illustrated in FIG. 2, FIG. 4, FIG. 5 and FIG. 6, the male connector main body 11 is provided with three male connector conductive parts 12, and the annular contact parts 121 of the three male connector conductive parts 12 are coaxially arranged at intervals; and the female connector main body 21, corresponding to each male connector conductive part 12, is provided with the female connector conductive parts 22 respectively, and each female connector conductive part 22 makes contact with the circumferential face of the annular contact part 121 of the corresponding male connector conductive part 12 respectively.

Each male connector conductive part 12 is provided with male connector wiring fixing parts 122, and the male connector wiring fixing parts 122 of the male connector conductive parts 12 are screwed and fastened on the male connector main body 11 through locking screws; and similarly, each female connector conductive part 22 is provided with a female connector wiring fixing part 222, and the female connector wiring fixing parts 222 of the female connector conductive parts 22 are screwed and fastened on the female connector main body 21 through locking screws.

The male connector main body 11 and the female connector main body 21 of the disclosure can be designed by adopting the following structures, specifically, the male connector main body 11 comprises a circular-ring-shaped male connector sleeve part 111, a male connector fixing part 112 is arranged on the inner side of the male connector sleeve part 111, and the male connector sleeve part 111 and the male connector fixing part 112 are of an integrated structure; similarly, the female connector main body 21 comprises a circular-ring-shaped female connector sleeve part 211, the female connector sleeve part 211 and the male connector sleeve part 111 are rotationally connected in the 360-degree rotatable manner, a female connector fixing part 212 is arranged on the inner side of the female connector sleeve part 211, and the female connector sleeve part 211 and the female connector fixing part 212 are of an integrated structure; and during installation, the male connector wiring fixing parts 122 are screwed and fastened to the male connector fixing part 112 through locking screws, and the female connector wiring fixing parts 222 are screwed and fastened to the female connector fixing part 212 through locking screws.

To guarantee the installation stability and reliability of the male connector conductive parts 12, the male connector conductive parts 12 of the disclosure are designed by adopting the following structure, specifically, each male connector conductive part 12 is provided with at least two male connector wiring fixing parts 122 which are circumferentially, annularly and uniformly distributed at intervals; and during installation, the male connector wiring fixing parts 122 of the male connector conductive parts 12 are screwed and fastened on the male connector fixing part 112 through locking screws, and the stability of the annular contact parts 121 of the male connector conductive parts 12 can be guaranteed in a multi-point fixation mode.

To guarantee that the female connector conductive parts 22 are stably and reliably in contact with the corresponding male connector conductive parts 12, the female connector conductive parts 22 of the disclosure are designed by adopting the following structures, specifically, each female connector conductive part 22 is provided with an elastic contact part 221 which is curved and protrudes towards the side of the annular contact part 121 of the corresponding male connector conductive part 12, and the elastic contact parts 221 of the female connector conductive parts 22 are elastically in contact with the annular contact parts 121 of the male connector conductive parts 12.

Furthermore, as illustrated in FIG. 1 to FIG. 5, the male connector main body 11 is provided with a male connector cover body 13, and male connector plug wire holes for wires connected with the male connector conductive parts 12 to pass through are formed between the male connector cover body 13 and the male connector main body 11. Similarly, the female connector main body 21 is provided with a female connector cover body 23, and female connector plug wire holes for wires connected with the female connector conductive parts 22 to pass through are formed between the female connector cover body 23 and the female connector main body 21.

The male connector cover body 13 is screwed and fastened to the male connector main body 11, and the female connector cover body 23 is screwed and fastened to the female connector main body (21); and certainly, the assembling fixation mode of the male connector cover body 13 and the female connector cover body 23 does not limit the disclosure, namely, the male connector cover body 13 of the disclosure can be installed on the male connector main body 11 in other modes, and the female connector cover body 23 of the disclosure can be installed on the female connector main body 21 in other modes.

When the device is applied to the Christmas trees for achieving power connection, the wire, connected with the male connector conductive part 12, of the male connector wiring fixing part 122 stretches out of a male connector thread hole 14, and the wire, connected with the female connector conductive part 22, of the female connector wiring fixing part 222 stretches out of a female connector thread hole 24; when the male connector assembly 1 and the female connector assembly 2 are in butt joint, the male connector main body 11 is in sleeve joint with the female connector main body 21, the male connector main body 11 and the female connector main body 21 can rotate relatively in a 360-degree circumferential manner, and when the male connector assembly 1 and the female connector assembly 2 are in butt joint in place, the elastic contact parts 221 of the female connector conductive parts 22 are in contact with the annular contact parts 121 of the corresponding male connector conductive parts 12, and at the moment, the male connector assembly 1 and the female connector assembly 2 are electrically conducted; and when the male connector main body 11 and the female connector main body 21 rotate relatively, the female connector conductive parts 22 are still kept in electrical contact and conduction with the corresponding male connector conductive parts 12.

In conclusion, by means of the structural design, the male connector assembly 1 and the female connector assembly 2 can rotate by 360 degrees to adjust the positions according to needs, and electrical conduction can still be guaranteed when the positions are adjusted in a rotating mode, namely, the device has the advantages of being novel in design, simple in structure and convenient to use.

The foregoing merely depicts some illustrative embodiments according to the present disclosure, those skilled in the art will be able to make various modifications to specific embodiments and scope of application in accordance with the spirts of the present disclosure, and the details of the description should not interpreted as limiting the present disclosure.

What is claimed is:

1. A quick conductive connector device for Christmas trees, comprising a male connector assembly and a female connector assembly matched with the male connector assembly;

the male connector assembly comprises a male connector main body, the female connector assembly comprises a female connector main body which is configured to be sleeved on the male connector main body in a 360-degree rotatable manner, and the male connector main body and the female connector main body are plastic insulative parts;

the male connector main body is provided with male connector conductive parts, each of which comprising a circular-ring-shaped annular contact part, and the female connector main body is provided with female connector conductive parts that are in contact with circumferential faces of the annular contact parts of the male connector conductive parts.

2. The quick conductive connector device for Christmas trees as recited in claim 1, wherein the male connector main body is provided with three male connector conductive parts, and the annular contact parts of the three male connector conductive parts are coaxially arranged at intervals;

and the female connector main body is provided with one female connector conductive part corresponding to each of the male connector conductive parts, and each female connector conductive part is in contact with a circumferential face of the annular contact part of the corresponding male connector conductive part.

3. The quick conductive connector device for Christmas trees as recited in claim 1, each of the male connector conductive parts is provided with a male connector wiring fixing part, and the male connector wiring fixing part of the male connector conductive part is screwed and fastened onto the male connector main body through a locking screw;

and each of the female connector conductive parts is provided with a female connector wiring fixing part, and the female connector wiring fixing part of the female connector conductive part is screwed and fastened onto the female connector main body through a locking screw.

4. The quick conductive connector device for Christmas trees as recited in claim 3, wherein the male connector main body comprises a circular-ring-shaped male connector sleeve part, and wherein a male connector fixing part is arranged on an inner side of the male connector sleeve part, and wherein the male connector sleeve part and the male connector fixing part are integrally formed as a whole;

the female connector main body comprises a circular-ring-shaped female connector sleeve part, the female connector sleeve part and the male connector sleeve part are connected in the 360-degree rotatable manner, wherein a female connector fixing part is arranged on an inner side of the female connector sleeve part, and wherein the female connector sleeve part and the female connector fixing part are integrally formed as a whole;

and the male connector wiring fixing part is screwed and fastened onto the male connector fixing part through a locking screw, and the female connector wiring fixing part is screwed and fastened onto the female connector fixing part through a locking screw.

5. The quick conductive connector device for Christmas trees as recited in claim 4, wherein each of the male connector conductive parts is provided with at least two male connector wiring fixing parts which are circumferentially and uniformly distributed at intervals.

6. The quick conductive connector device for Christmas trees as recited in claim 4, wherein each of the female connector conductive parts is provided with an elastic contact part which is curved and protrudes towards the side of the annular contact part of the corresponding male connector conductive part, and the elastic contact part of the female connector conductive part is elastically in contact with the annular contact part of the corresponding male connector conductive part.

7. The quick conductive connector device for Christmas trees as recited in claim 1, wherein the male connector main body is provided with a male connector cover body, and wherein there are provided male connector plug wire holes configured for wires connected with the male connector conductive parts to pass through between the male connector cover body and the male connector main body;

and the female connector main body is provided with a female connector cover body, and wherein there are provided female connector plug wire holes for wires connected with the female connector conductive parts to pass through between the female connector cover body and the female connector main body.

8. The quick conductive connector device for Christmas trees as recited in claim 7, wherein the male connector cover body is screwed and fastened onto the male connector main body, and the female connector cover body is screwed and fastened onto the female connector main body.

* * * * *